US005722169A

United States Patent [19]

Özden

[11] Patent Number: 5,722,169

[45] Date of Patent: Mar. 3, 1998

[54] POINTED WEAPON WITH A SPRINGING DEVICE

[76] Inventor: Birol Özden, Wormser Str. 51, D-50677 Cologne, Germany

[21] Appl. No.: 619,533

[22] PCT Filed: Sep. 17, 1994

[86] PCT No.: PCT/DE94/01078

§ 371 Date: May 15, 1996

§ 102(e) Date: May 15, 1996

[87] PCT Pub. No.: WO95/09341

PCT Pub. Date: Apr. 6, 1995

[30] Foreign Application Priority Data

Sep. 27, 1993 [DE] Germany ..... 43 32 833.4

[51] Int. Cl.[6] ..... F41B 13/06

[52] U.S. Cl. ..... 30/162; 30/298

[58] Field of Search ..... 30/162, 163, 296.1, 30/298

[56] References Cited

U.S. PATENT DOCUMENTS

| | | | |
|---|---|---|---|
| 1,260,827 | 3/1918 | Stefanov | 30/162 |
| 1,314,672 | 9/1919 | Kozlowski | 30/162 |
| 1,322,775 | 11/1919 | Fallon | 30/298 |
| 2,352,921 | 7/1944 | Stoltz | 30/296.1 |
| 2,665,478 | 1/1954 | Clemens | 30/297 |
| 4,996,773 | 3/1991 | Albertson | 30/298 |
| 5,058,278 | 10/1991 | Colvin | 30/298 |
| 5,161,309 | 11/1992 | Graves | 30/297 |

FOREIGN PATENT DOCUMENTS

| | | | |
|---|---|---|---|
| 1122971 | 5/1956 | France | 30/162 |

*Primary Examiner*—Hwei-Siu Payer
*Attorney, Agent, or Firm*—K. S. Cornaby

[57] ABSTRACT

The dagger described has a spring device. A pointed blade (24) is mounted so that it can move in a housing (20) from a retracted position to a projecting position. A spring (30) is fitted between the housing (20) and the blade (24) to bias the blade (24) towards the projecting position. A releasable catch (26) fitted to the housing (20) engages in a recess (28) in the blade (24) when the blade (24) is in the retracted position and secures the blade so that it cannot be forced back into the housing (20) when the blade (24) is in the projecting position. The catch (26) has a release element (44) made of flexible, high-tensile strength material in the form of a loop (46) in which a finger can be inserted. The housing (20) has a baseplate (40) and attachment straps by means of which the dagger can be secured to the user's forearm (41).

10 Claims, 3 Drawing Sheets

POINTED WEAPON WITH A SPRINGING DEVICE

Figure 1:
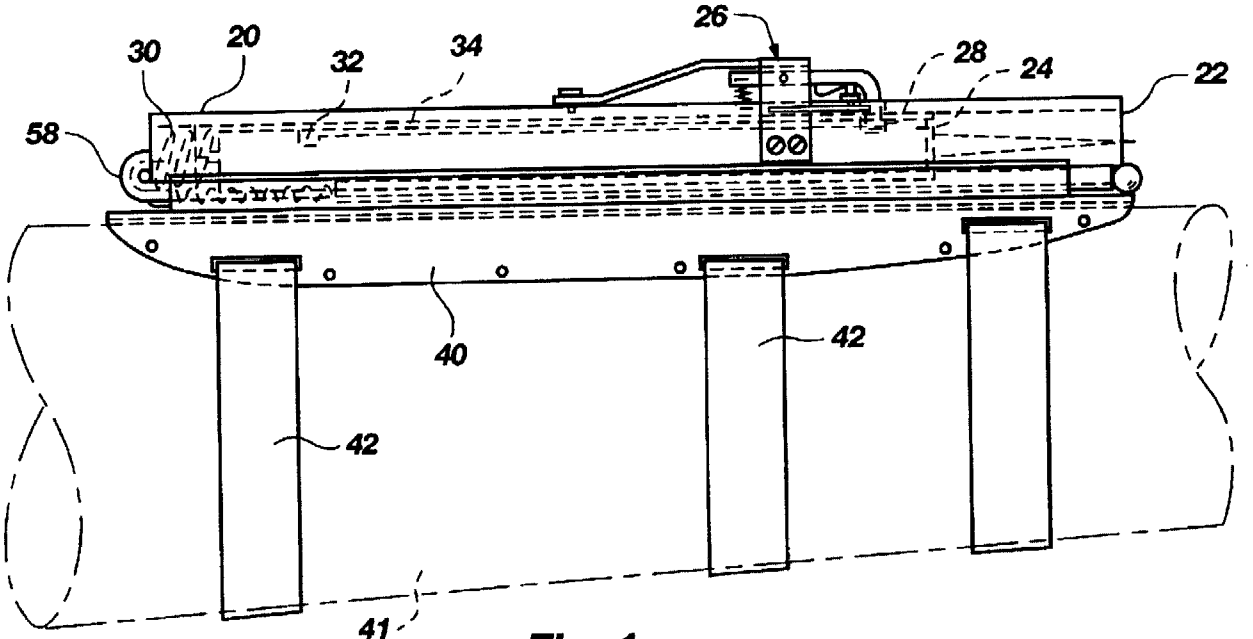

The invention relates to a pointed weapon with a springing device, with which a pointed blade is slidably lead into a shaft and can be moved from a retractable home position into a projecting position, where a spring is arranged between the shaft and the blade, which prepressures the blade into a projecting position and where an engaging and disengaging stop work is planned at the shaft, which in the home position engages into a catch recess provided in the blade and in the projecting position secures the blade against being pushed back into the shaft.

For security tasks, i.e., for personal security by so-called bodyguards or bouncers of discoteks weapons are needed, which can be carried in such a way that they normally, meaning when not in use, practically do not show and which in the case of use can be put into action quickly and without awkward manipulation as well as being effective thereby. Fire arms are not always used in such cases, especially as the pulling of a gun from a holster, being hidden away, always requires a major action and can be recognized and avoided by an adversary, who is directly close. Pointed weapons also, i.e., jack knives, would have to be pulled, seized and unlocked from a hidden supporting part or a holster, before they can be used. All this takes time and movement, which do not only offer an advantage to a decisive, quickly-acting adversary, but also diminishes the element of surprise of the fact that a weapon has appeared.

This is where the invention starts. It is the task of the invention to further develop a pointed weapon of the above-mentioned kind in such a way that on one hand the weapon can be carried as inconspicuously as possible, so that it does not show normally, but can be pulled out extremely quickly and used directly for an attack, so that the fast provision confronts the adversary with an element of surprise.

Departing from the pointed weapon of the above mentioned kind the task is involved in such a way, that the stop-work comprises a release element, which is made from flexible, tensile material showing a loop for a finger, and that the shaft comprises a supporting part of a strapping device with which the pointed weapon can be put on and attached to the forearm of a human being.

This pointed weapon has the major advantage that it is already sufficiently secured to an arm, with which an attack or a threat of an attack is being executed normally, as is necessary for an attack. By means of its supporting part and the strapping device, the pointed weapon is tightly secured at the forearm of a human being. It does not stand out of the sleeve of a normal jacket, meaning that it does not end before the wrist. The blade is completely retracted within the shaft in the home position, and therefore it cannot be seen.

The stop work can be set into action via a flexible element, as a flexible element, i.e., a cord, a nylon wire or something similar can be used. The flexible element shows a loop for a finger, which the user puts around a finger, where the flexible element runs across the back of the hand. It is stretched in such a way that when bending the hand in the region of the wrist and the first joints of the fingers, sufficient tension is exerted on the elastic element that the stop work is being released. Then the blade, which is moved by spring action towards the front, is released from the stop work. The blade either moves into the projecting position by the spring action already or still needs to be moved into it, i.e. it can be moved into the projecting position by its dead weight or by its inert mass when an attack is being executed. By moving the hand away from the opening of the shaft for stretching the flexible element and releasing the stop work, there is no danger of the protruding blade touching or even hurting the user.

In the projecting position the blade locks in the manner known, for this the stop work is also used preferably. In an alternate embodiment a separate stop work for the locking of the projecting position can also be provided.

The pointed weapon according to the invention can therefore not only be carded inconspicuously, it can also be prepared very inconspicuously for an attack. This leads to a surprise with the person being attacked, who will rather show the desired reaction of retreat, as with an awkward preparation of a weapon according to the state of the art. The weapon can be executed very flatly, it does not visibly show when carried.

The supporting part is comprised and formed in such a way that it rests favorably on the exterior of the forearm of a user. Essentially, it is made of a lengthwise, bent, rigid section made from plastic or metal, i.e., it can be cut from a plastic tube of sufficient inside diameter. The strapping device engages directly into this supporting part and secures a tight hold of the supporting part on the forearm. The strapping device preferably consists of broad belts, which end in buckles or VELCRO® strips.

A secure hold on the forearm is gained by means of the prescribed construction of the supporting part and the strapping device. The hold is supposed to be as secure as with a normal knife held tightly in the hand.

In a preferred embodiment a reset element is provided, which is connected to the blade and comprises a handle, which is arranged near the opening of the shaft. Using the reset element, the blade can be retracted into the shaft, without making a demounting of the device necessary. The retraction occurs near the position of the location of the opening of the shaft, and for that reason the cover of the pointed weapon according to the invention, such as an item of clothing, does not have to be removed for pushing the blade back into its shaft. Preferably the reset device comprises a towing coupling in which, a flexible cord engages with the blade and is re, directed at the end of the shaft, which is situated opposite of the opening of the shaft, and then runs outside of the shaft to the handle, which is located near the free end or opening of the shaft.

The construction of the blade is quite optional. It can be of a flat construction, preferably consisting of a base body and a replacement point of the blade. The base body is either a shaped part, i.e., a square, or a round material. The shaft is accordingly shaped. When the base bodies are roundly shaped it is advantageous to avoid a tension against the shaft. This can be achieved, i.e., by a longitudinal slot in the base body, into which a projection engages, which protrudes from the shaft into the interior. This projection can be the stop work.

Figure 2:
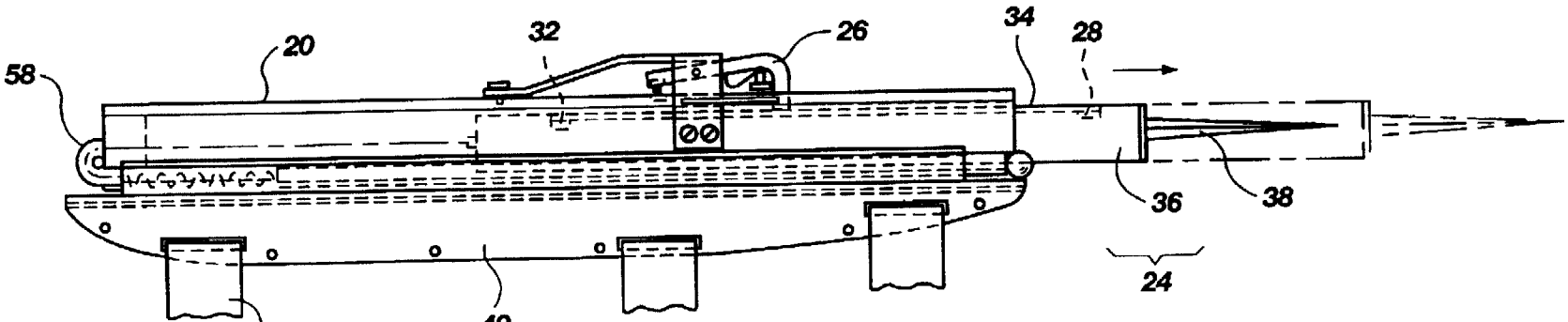
Figure 3:
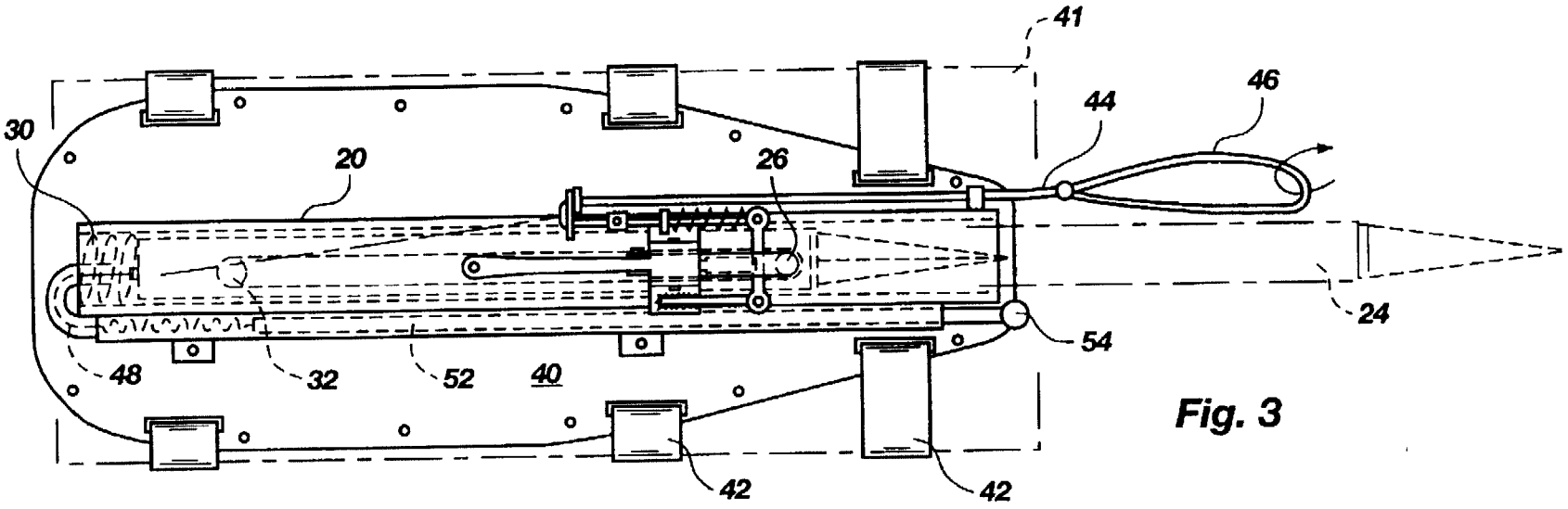
Figure 4:
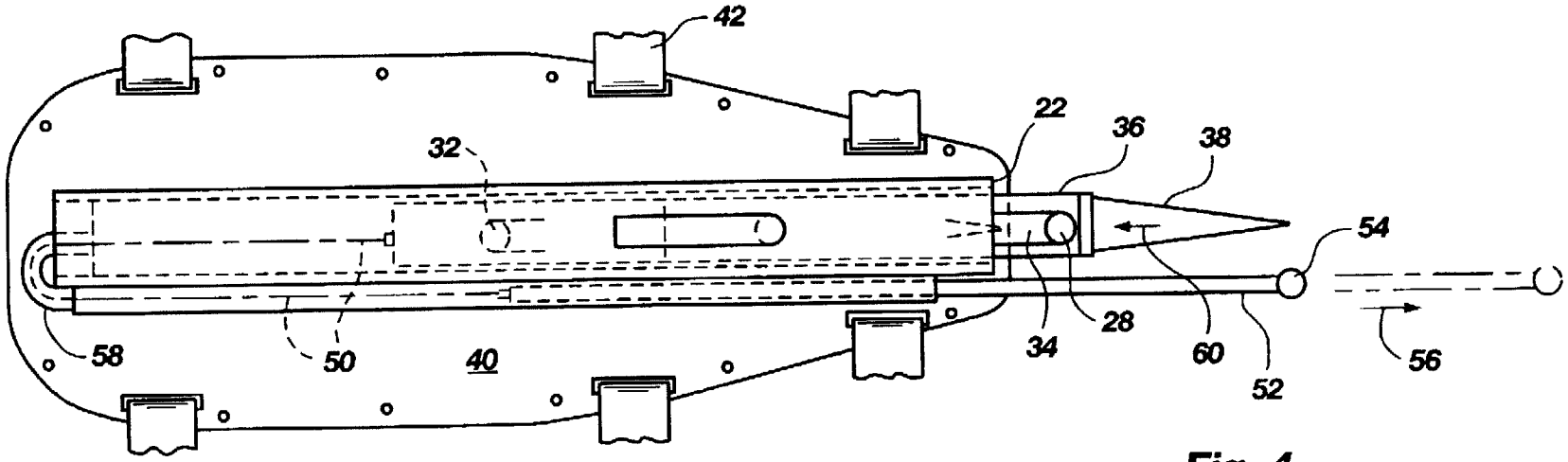
Figure 5:
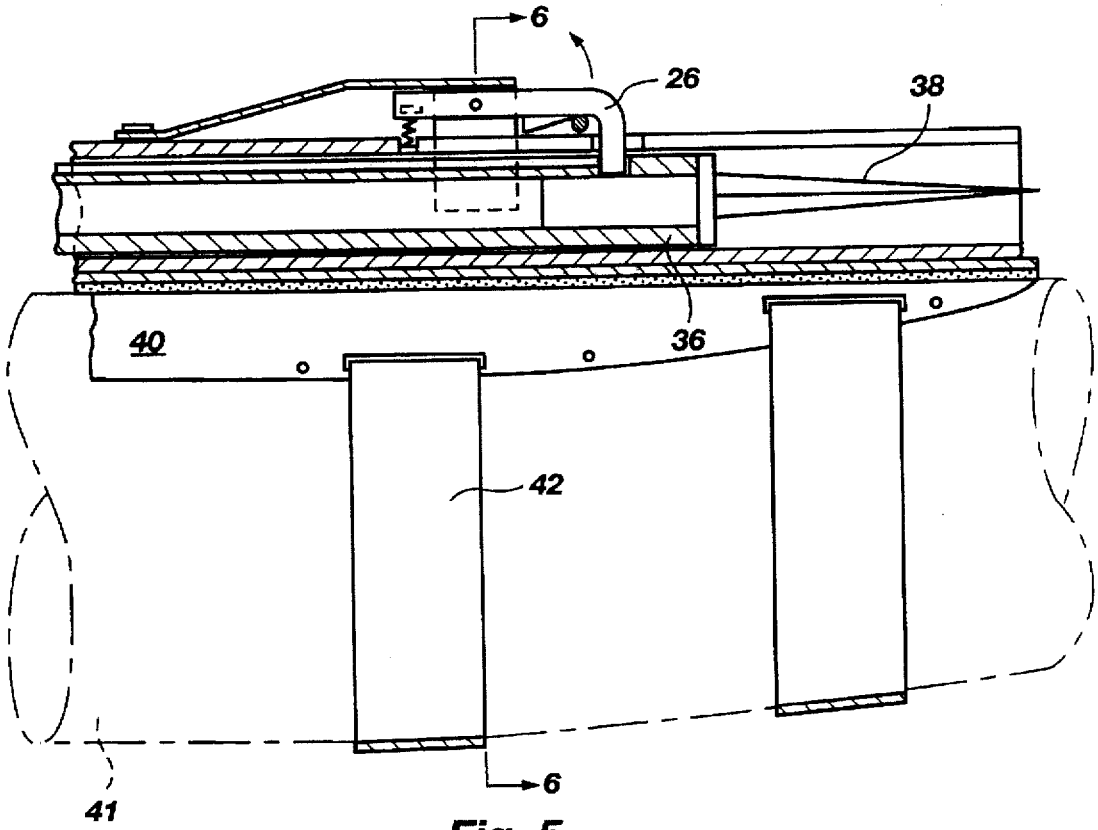
Figure 6:
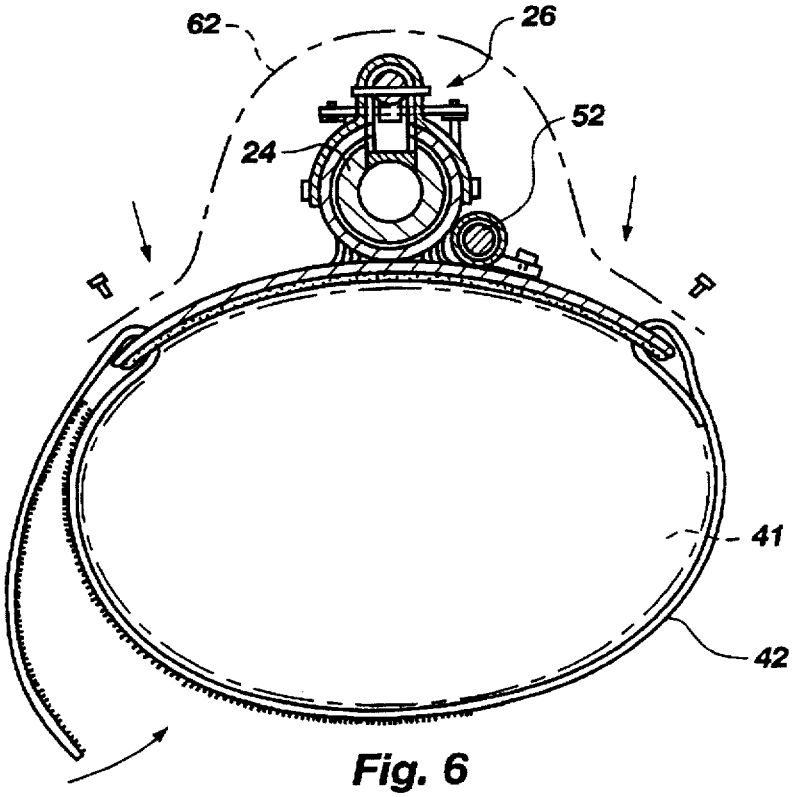

Further advantages and characteristics of the invention result from the respective claims and the following illustration of a non-restrictive embodiment of the invention, which will be explained with reference to the accompanying drawing. The drawing shows in:

FIG. 1: a side view of the pointed weapon strapped to the forearm, where the blade is in the retracted position;

FIG. 2: an illustration according to FIG. 1, but without the dotted lined arm, the blade being in an intermediate position between a home position and a projecting position;

FIG. 3: a top view onto the pointed weapon according to FIG. 1, the projecting position being illustrated with dotted lines;

FIG. 4: a view according to FIG. 3, where the retraction of the blade into the shaft is illustrated;

FIG. 5: a sectional view through essential parts of the arrangement according to FIG. 1 with the same way of the view; and FIG. 6: a sectional view taken along the sectional line VI—VI in FIG. 5.

As the figures show, the pointed weapon according to the invention shows a shaft 20 being formed by a tube. This is open at one end. This side will be called shaft opening 22 hereinafter. According to FIG. 1 directly beneath the shaft opening 22 a blade 24 is positioned in the home position in the shaft 20, which can—as will be explained later—be driven out of the shaft (see FIG. 2) and is then in a projecting position. In both positions it is fixed opposite the shaft 20, but not in the intermediate positions. In the home position this occurs by means of an engaging and disengaging stop work 26, which engages into a recess 28 of the blade 24. If the stop work is 26 pulled out of the recess 28 long enough, the stop work 26 is released of the blade 24, so that it is no longer held by the stop work 26.

Between shaft 20 and blade 24, a spring 30 formed as a coil pressure spring is arranged at the end of the shaft 20 being adverse to the shaft opening 22. Due to this spring 30, the blade 24 is pushed out of the shaft 20, as soon as the stop work 26 is released. In the embodiment shown, the spring 30 is designed in such a way that the blade 24 is pushed completely into the projecting position by its force. There it is kept by the stop work 26, which engages into a slot 32 which is provided in the blade 24. In this way, the blade 24 cannot be pulled out of the shaft. Slot 32 and recess 28 are connected with each other by a longitudinal slot 34 ensuring that the blade 24 cannot be twisted against the shaft 20.

The blade 24 consists of a base body 36 and a point 38, the point having a thread which can screwed into an axial threaded drill hole of the base body 36. Further embodiments of an engaging and disengaging attachment between base body 36 and point 38 are possible, i.e., a bayonet-type push-in attachment.

The shaft 20 is connected with a supporting part 40 on its entire length. It is about 8 cm wide and about 24 cm long. The supporting part 40 is a rigid part of partly cylindrical shape. In the top view it is essentially a lengthwise, nearly rectangular, part with strong roundings at the front and at the back in the area of the corners. Altogether it is shaped in such a way that it fits well on the outside of an arm. The roundings secure a comfortable attachment. At the edge of the supporting part 40 a strapping device 42 with several belts is provided. The belts, belonging together as a pair, can be stretched and closed. Together with the supporting part they form closed loops. By means of the strapping device 42 the supporting part 40 is kept tight to the forearm. The construction of the strapping device 42 is optional. In the embodiment shown, the belts are provided with a VELCRO® strip. A piece of lace which can be pulled into the provided holes on the edge of the supporting part is also possible. Generally, embodiments used with shoes, meaning, i.e. buckled straps for closure, etc., can be used for the strapping device.

The supporting part 40 is preferably upholstered on its concave surface facing the forearm 41. The same applies to the parts of the strapping device 42. By this a comfortable attachment is achieved.

The stop work 26 is connected to a release element 44. If the release element is pulled, the stop work 26 is released from the recess 28. The release element is made from a flexible, relatively smooth cord and ends in a finger loop 46. This is put around the finger of a user, for example around the ring finger or little finger, with the release element running across the back of the hand. By bending the hand in the wrist area and the first joint of the finger, the release element 44 is stretched and pulled so far that the stop work 26 is released. The cord of the release element 44, which can also be formed as a thin highly flexible wire made from plastic or as a flat band, is chosen in such a way that it should now show, preferably transparent or skin colored material being used. Furthermore the release element 44 should be formed as thinly as possible so that it shows as little as possible. It has proven to be very advantageous to make the width of the finger loop 46 adjustable, i.e., via an adjusting element, friction, spring, etc. That way the total length of the release element 44 can be adjusted to each user and each position of the supporting part 40 on the forearm.

The blade 24 is connected at its back end with a reset element 48. It is composed of a flexible cord 50 and a wand 52. The latter being lead into a tube, which is arranged directly next to the shaft 20 and connected with it. Cord 50 and wand 52 are connected with each other. The wand 52 ends in a handle 54, which is arranged directly next to the shaft opening 22 easy to be gripped. If this handle is pulled (see FIG. 4, arrow 56) a tension is executed on the wand 52, which carries the cord 50. This cord is extended in a U-shaped guide, which is formed as a piece of tube 58. By pulling the cord 50 the blade 24 is pulled backwards (arrow 60). If that occurs so that the blade 24 engages into the stop work 26 with its recess 28, the home position is reached. By means of the reset element 48 the blade 24 can be moved back into its home position without having to unstrap the pointed weapon, a sleeve covering the pointed weapon having to be pulled up or another manipulation having to be operated. When the cord 50 is pulled back from an encompassing screw-on extension spring, it takes the wand 52 back into the starting position. (FIG. 2).

A wand does not have to be provided necessarily. By means of a top 62 the pointed weapon can be covered on the outside.

It has proven to be a very advantageous to fix the flexible release element 44 right to the end of the shaft additionally, as illustrated in FIG. 3 with a dotted line, i.e., by a wire. By hitting this part of the release element 44, i.e., in defense, the release element is stretched and the stop work 26 is also released. A similar effect is reached, if the stop work 26 has a relatively large mass. By moving the pointed weapon abruptly, the stop work is released due to slowness only for a short period of time, but sufficiently, however.

In a further preferred embodiment not illustrated the pointed weapon is constructed very flat. The blade is a flat piece of metal similar to a knife blade, which can glide over the surface of the supporting part and is lead via guide rails or braces ejecting from the supporting part or being fitted onto it. Preferably, the stop work is arranged collaterally of the blade.

I claim:

1. A pointed weapon with springing device, with which a pointed blade is slidably lead into a shaft and can be moved from a retractable home position into a projecting position, where a spring is arranged between the shaft and the blade, which prepressures the blade into the projecting position and where an engaging and disengaging stop work is planned at the shaft, which in the home position engages a catch recess provided in the blade and in the projecting position secures the blade against being pushed back into the shaft, characterized by the stop work comprising a release element made from flexible tensile material and comprising a loop for a finger and said weapon further comprises a supporting part and a strapping device, with which the pointed weapon can be put on and attached to a forearm of a human being.

2. A pointed weapon according to claim 1 characterized by the supporting part being a U-shaped, twisted, rigid part, preferably a tube section.

3. A pointed weapon according to claim 1 or 2 characterized by the strapping device comprising several flexible hasps each having a VELCRO® strip.

4. A pointed weapon according to one of the claim 1 characterized by the blade being connected with a reset element, which comprises a handle.

5. A pointed weapon according to one of the claim 1 characterized by said release element for the stop work being provided at the side of the shaft being aside of the supporting part.

6. A pointed weapon according to one of the claim 1 characterized by the blade comprising a replaceable point of the blade.

7. A pointed weapon according to one of the claim 1 characterized by the shaft being formed as a flat profile or of tubular shape.

8. A pointed weapon according to one of the claim 1 characterized by the blade comprising a flat profile, being formed to a knife blade.

9. A pointed weapon according to one of the claim 1 characterized by the supporting part formed of a partial cylindrical shape.

10. A pointed weapon according to one of the claim 1 characterized by the stop work being arranged collaterally of the blade.

* * * * *